US005253954A

United States Patent [19]

Landsberger

[11] Patent Number: 5,253,954

[45] Date of Patent: Oct. 19, 1993

[54] ALTERNATE INTAKE PIPE SYSTEM TO ELIMINATE ZEBRA MUSSEL COLONIZATION

[75] Inventor: Samuel E. Landsberger, Ithaca, N.Y.

[73] Assignee: Cornell Research Foundation, Inc., Ithaca, N.Y.

[21] Appl. No.: 913,014

[22] Filed: Jul. 14, 1992

[51] Int. Cl.[5] ..... E03B 3/04

[52] U.S. Cl. ..... 405/127; 137/236.1; 137/599; 405/83; 405/158

[58] Field of Search ..... 137/1, 565, 599, 601, 137/602; 405/83, 127, 158, 169, 170, 171; 138/114

[56] References Cited

U.S. PATENT DOCUMENTS

| | | | |
|---|---|---|---|
| 2,838,074 | 6/1958 | Lauck | 138/114 |
| 3,379,027 | 4/1968 | Mowell et al. | 137/236.1 X |
| 3,479,831 | 11/1969 | Teague | 405/170 |
| 3,592,238 | 7/1971 | Scheffler | 138/114 |
| 3,958,026 | 5/1976 | Leone et al. | 426/332 |
| 3,964,754 | 6/1976 | Murai et al. | 277/101 |
| 4,014,369 | 3/1977 | Kobres, Jr. | 138/112 |
| 4,413,655 | 11/1983 | Brown | 138/97 |
| 4,906,496 | 3/1990 | Hosono et al. | 428/36.9 |
| 5,040,487 | 8/1991 | Bollyky et al. | 119/4 |
| 5,152,637 | 10/1992 | Wayne | 405/127 |

FOREIGN PATENT DOCUMENTS

| | | | |
|---|---|---|---|
| 643586 | 1/1979 | U.S.S.R. | 405/127 |

*Primary Examiner*—Stephen M. Hepperle
*Attorney, Agent, or Firm*—Jones, Tullar & Cooper

[57] ABSTRACT

A method and apparatus for eliminating zebra mussel colonizations from fresh water intake pipes for facilities, such as power plants and water treatment plants, are disclosed. One or more small diameter alternate intake pipes are disposed within a main intake pipe, and the pipes are connected by means of individually controllable valves to a pump for supplying water to the facility. Zebra mussel build up along the interior walls of any of the pipes is eliminated by shutting off flow in any mussel infested pipes with the valves, which causes starvation of the mussels due to suffocation. When water flow is resumed, the dead mussels are easily washed out of the pipes. The alternate intake pipes can be made of inexpensive flexible material, such as rubber, since they are not exposed to the environment external to the main intake pipe. In addition, a non-stick coating, such as silicone, can be disposed on the interior walls of the alternate pipes to further prevent mussel build up. A number of techniques for installing the one or more alternate pipes within an existing pipe are also disclosed.

19 Claims, 4 Drawing Sheets

FIG. 1
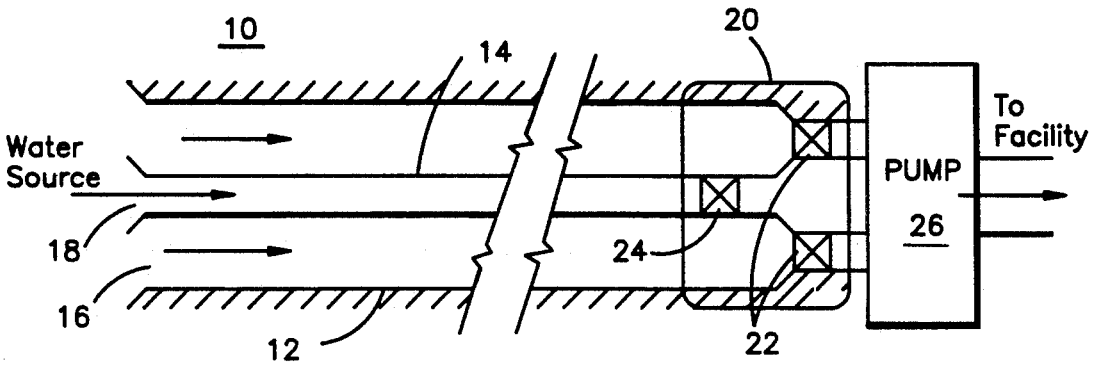
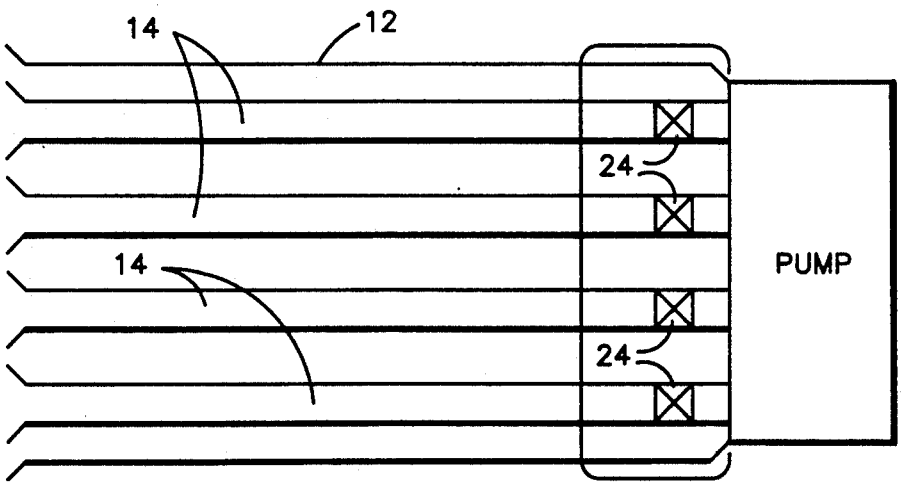
FIG. 2

ALTERNATE INTAKE PIPE SYSTEM TO ELIMINATE ZEBRA MUSSEL COLONIZATION

BACKGROUND OF THE INVENTION

The present invention relates to a method and apparatus for eliminating zebra mussel colonization in intake pipes for power plants, or the like, which makes use of alternate intake pipes.

In recent years, infestation of fresh water pipe inlets by zebra mussels has presented a serious problem to power plants, manufacturing facilities, refineries and municipal water suppliers which draw water from the Great Lakes. Zebra mussels have been spreading throughout the Great Lakes since they were first discovered in 1988 in Lake Saint Clair, and are continuing to spread southward into the United States. These organisms attach themselves to the inner surfaces of large diameter fresh water inlet pipes for facilities such as power stations, water treatment plants, etc., and quickly reproduce to such an extent that water flow through the pipes is impeded, thereby adversely affecting the facility's operation. This usually requires shutdown of the facility so that measures can be taken to remove the mussels from the pipes.

Various techniques have been proposed to cope with this problem which either prevent the attachment and growth of the mussels in the first place, or provide a mechanical removal process. The prevention techniques include the use of chemicals, such as chlorine, or the use of heat treatment in which hot water is caused to flow through the pipes periodically. The use of chemicals, although effective, is not permitted in most instances because of Environmental Protection Agency regulations, while the use of hot water treatment requires the installation of additional equipment which may be too costly.

Various mussel cleaning and removal techniques have also been proposed and include the use of human divers and mechanical "pigs" which are simple water pressure driven scrapers that work themselves along the lengths of the pipes. Divers are currently the most commonly employed means for scraping mussels from pipe walls, but this is unsafe, prohibitively expensive and requires pipe shutdown. Mechanical pigs or robots have been used with success in mildly obstructed pipes where access to the inlet is not difficult and where pipes can be shutdown for prolonged periods of time. If the pipes are excessively clogged, however, the pigs have a tendency to get stuck in them. In addition, most facilities in the United States do not have redundant pipelines and the shutdown of the pipes for prolonged periods of time is therefore prohibited. Further, access to the pipes is often made difficult because of sharp bends or corners and other protrusions which get in the way of the pigs and prevent them from advancing through the pipes.

Another method for removing the mussels once they have infested an intake pipe employs the use of redundant intake pipes. When the main intake pipe becomes clogged by the mussels, the water flow is diverted through the redundant pipe so that the mussels in the main intake pipe will suffocate. Water flow through the main intake pipe is then resumed and the dead mussels are washed through the pipe since they no longer readily adhere to the pipe's interior wall. The main drawback to this method is again, that it is too costly since it requires installation of a second separate intake pipe system for facility.

In view of the drawbacks of the above known techniques for preventing or eliminating zebra mussel colonization in intake pipes, what is needed then is a new technique which avoids these drawbacks.

SUMMARY OF THE INVENTION

In view of the foregoing, it is therefore the object of the present invention to provide a method and apparatus for eliminating zebra mussel colonization in intake pipes which avoids the need to shutdown the facility serviced by the pipes, yet also avoids the need to employ mechanical means to remove the mussels during pipe operation, thereby eliminating the need for divers or mechanical "pigs".

It is another object of the present invention to provide a method and apparatus for eliminating zebra mussel colonization in intake pipes in which infested intake pipes can be shutdown to eliminate the mussels without requiring plant shutdown or separately positioned and installed redundant intake pipes.

These and other objects of the present invention are achieved through use of an intake pipe system in which one or more alternate intake pipes are installed within a main intake pipe so that water flow through the main intake pipe can be shutdown for removal of zebra mussels therefrom, while water flow is maintained through the alternate intake pipes to provide continued water flow to the facility being served. Although the alternate intake pipes are smaller in diameter than the main intake pipe, adequate water flow to the facility can still be maintained by simply increasing pump pressure. This is feasible in most instances because many utilities employ water pumps which are substantially oversized for their current capacity, and the increased pressure can therefore generally be achieved without upgrading the current pump capacity.

The invention enables water using utilities currently using only one intake pipe to convert to a multi-intake pipe system at relatively low cost by introducing the alternate pipes inside of the existing pipe. This greatly reduces installation costs since new trenches and pipe supports need not be constructed for the alternate pipes. Further, since the alternate pipes are housed in the relatively protected environment of the original intake pipe, they can be much less rugged than the exposed main pipe. Thus, cheaper pipe, such as flexible hose type pipe similar to that used in sewer pumping systems, can be employed for the alternate intake pipes.

In the method of the present invention, once the one or more alternate intake pipes have been positioned within the existing intake pipe and valves have been installed to control flow through the pipes, water flow through the main intake pipe is shut off and directed only through the alternate pipes. Any mussels which have affixed themselves to the interior wall of the main intake pipe will then either suffocate from lack of oxygen in the stagnant water, or can be killed by application of small amounts of chlorine. Since this method is one of starvation rather than poisoning, it is inherently safer for the water consumers and the environment since all chemicals known to kill the mussels have known or suspected adverse side effects, and are likely to come under increased scrutiny by the EPA. Once the mussels in the main intake pipe have been killed, water flow through it is resumed, and the dead mussels are flushed from the pipe's interior wall so that no mechanical scraping or cleaning is required.

When a plurality of alternate intake pipes is employed, flow through the pipes can be sequentially cycled to discourage mussel build up in any one of the alternate intake pipes, or in the main intake pipe. It is further envisioned that if a large number of alternate intake pipes is employed which substantially fill the interior space of the main intake pipe, the alternate intake pipes can entirely replace the main intake pipe for water flow. In this case, the interior surfaces of each of the alternate intake pipes can be coated with a non-stick substance, such as silicone, to which mussels cannot adhere. If the mussel build up can be avoided in this manner, it will be unnecessary to employ valves with each of the alternate intake pipes, thus simplifying the alternate intake pipe system and reducing its cost.

The invention also provides a number of different methods for installing the one or more alternate intake pipes within an existing main intake pipe. Two of the methods employ the use of a cable crawling underwater robot which advances along a cable disposed within the main intake pipe, and either assembles a plurality of interlocking pipe sections for each of the alternate intake pipes, or advances a one piece flexible pipe through the main intake pipe. Two variations of another installation method employ the use of a moving cable which advances individual pipe sections into the main intake pipe through use of apertured tabs disposed either within the pipe sections or on their exteriors, and a plurality of pressure beads on the moving cable. The pressure beads engage the tabs and cause the pipe sections to be advanced through the main intake pipe. As each of the sections engage one another, the pressure beads slip so that the cable can continue to move. After all of the pipe sections are in place, a nonslipping pressure bead is attached to the moving cable and advanced through the main intake pipe. As it advances, it engages the other pressure beads and causes each of the apertured tabs to break away, thus eliminating any flow impediment caused thereby.

BRIEF DESCRIPTION OF THE DRAWINGS

The foregoing and additional objects, features and advantages of the present invention will become apparent from the following detailed description of preferred embodiments thereof, taken in conjunction with the accompanying drawings in which:

FIG. 1 is a schematic diagram of an intake pipe system constructed in accordance with the present invention;

FIG. 2 is a schematic diagram of a modified version of the system of FIG. 1;

DETAILED DESCRIPTION OF THE PREFERRED EMBODIMENTS

Figure 3:
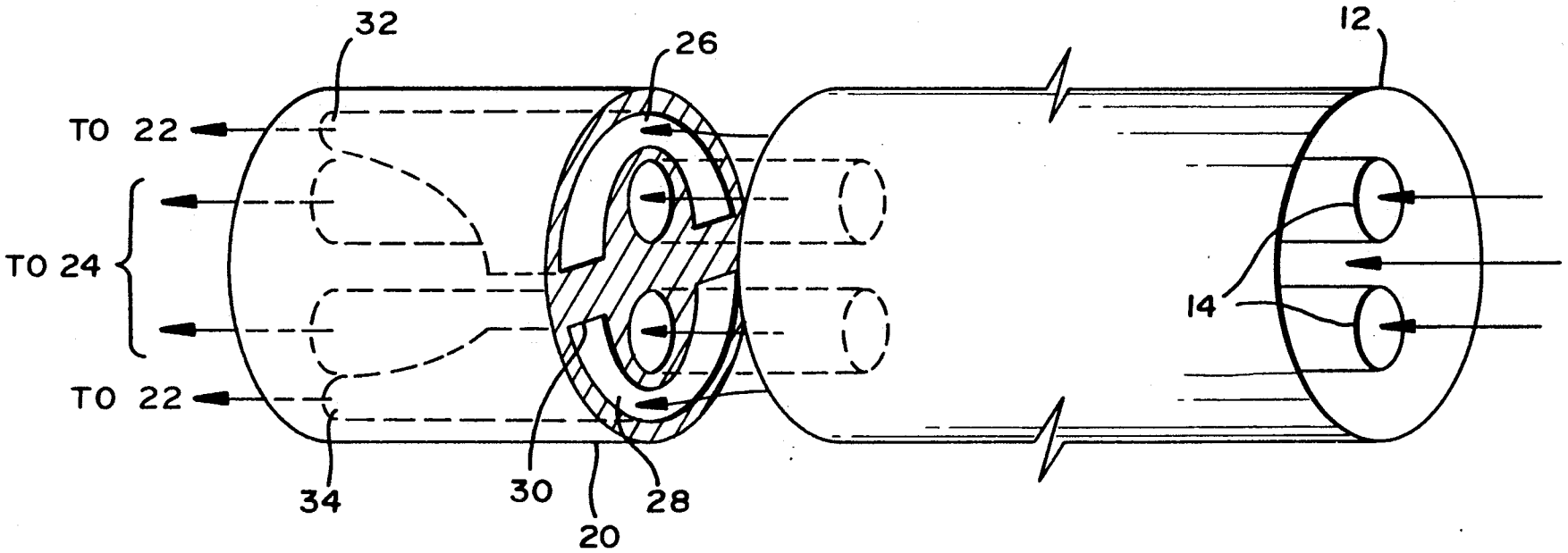
FIG. 3 is a schematic diagram of a valve manifold used in the intake pipe system; and, FIGS. 4–7 are schematic diagrams illustrating different techniques for installing alternate intake pipes in an existing intake pipe.

Turning now to a more detailed consideration of a first preferred embodiment of the present invention, FIG. 1 illustrates an intake pipe system 10 comprising a main intake pipe 12 having a smaller diameter, alternate intake pipe 14 disposed therein. Both of the pipes 12 and 14 have an inlet illustrated at 16 and 18, respectively, disposed to receive fresh water from a source, such as a lake or river. The pipes 12 and 14 feed into a valve manifold 20, which is discussed in greater detail below in conjunction with FIG. 3, and contains first and second valves 22 for controlling water flow through the main intake pipe 12, and a third valve 24 for controlling water flow through the alternate pipe 14. The valves 22 and 24 can be remotely actuated by any suitable conventional valve actuator means (not shown). From the valve manifold 20, the water is drawn through a pump 26 and to a facility (not shown), such as a power plant or water treatment plant, for example.

Since the alternate pipe 14 is shielded from the exterior environment by the main intake pipe 12, it can be made from less durable materials, such as rubber or flexible plastic. As will be discussed further below, the use of these materials not only saves money, but aids in the installation of the alternate pipe 14, especially when the main intake pipe 12 is either obstructed and/or includes numerous joints or bends along its length.

In the operation of the intake pipe system 10, all three of the valves 22 and 24 are normally open so that water flows through both the main intake pipe 12 and the alternate intake pipe 14. Periodically, or when it is determined that zebra mussel build up has occurred on the interior wall of the main intake pipe 12, the first and second valves 22 are closed so that water will now only flow through the alternate intake pipe 14. The mussels in the main intake pipe 12 will subsequently die from lack of oxygen in the stagnant water remaining in the pipe 12, or if necessary, small amounts of oxidizing chemicals, such as chlorine, can be added to the stagnant water to kill the mussels. Once the mussels have been killed, the first and second valves 22 are reopened so that water flow will resume through the main intake pipe 12, and the dead mussels will be washed away.

In a similar manner, if mussel build up occurs in the alternate intake pipe 14, water flow through it can be shut off by closing the third valve 24. Alternatively, the alternate intake pipe 14 can be coated with a non-stick substance, such as silicone, to which mussels cannot adhere. In this case, the third valve 24 can be eliminated, and only the flow through the main intake pipe 12 will need to be controllable. It further should be noted that since the diameter of the alternate intake pipe 14 is considerably smaller than that of the main intake pipe 12, the flow rate through the alternate intake pipe 14 is considerably higher when the main intake pipe 12 is shut off, and the resulting higher water velocity also assists in reducing any mussel build up in the alternate pipe 14.

In an alternative embodiment of the present invention as illustrated in FIG. 2, a plurality of the alternate pipes 14 are disposed inside the main intake pipe 12. During normal operation, the plural alternate pipes 14 are used in tandem with one another and the main intake pipe 12 thus realizing approximately full flow conditions, and placing little extra burden on the pumps. Periodically, flow in one or more of the pipes 12 or 14 is shut off by means of the valves 24 to eliminate any mussel build up. This is done frequently enough so that only limited numbers of mussels will be allowed to accumulate, and that either cleaning will not be necessary, or if necessary, will not be difficult. If a large enough number of the alternate intake pipes 14 is used, the entire water flow for the facility can be handled by them so that the main intake pipe 12 is no longer used. If this is the case, and non-stick coatings are disposed on the interior walls of the alternate intake pipes 14, then mussel build up can be prevented in the first place, and none of the valves 24 will be needed.

Turning now to FIG. 3, the details of a preferred embodiment of the valve manifold 20 are illustrated. In this embodiment, two of the alternate intake pipes 14 are shown disposed within the main intake pipe 12, and these feed directly through the manifold 20 to their respective control valves 24, not shown. Water flow through the main intake pipe 12 is split in the manifold 20 into first and second main intake passages 26 and 28, respectively, by means of a dividing wall 30 disposed in the main intake pipe 12. Water flow in the first main intake passage 26 is funneled into a first pipe 32 which feeds into the first of the main intake control valves 22, not shown, while flow in the second main intake passage 28 is funneled into a second pipe 34 which feeds into the second of the main intake control valves 22, also not shown. This construction of the manifold 20 solves the problem of controlling the water flow through the main intake pipe 12 where the use of a conventional valve is precluded due to the presence of the one or more alternate intake pipes 14 therein.

The one or more alternate intake pipes 14 can be positioned within an existing main intake pipe 12 using any of a number of methods as illustrated in FIGS. 4–7. Two of these methods make use of a cable crawling underwater robot, such as the one disclosed in U.S. patent application Ser. No. 07/831,878, filed Feb. 6, 1992, which is hereby incorporated by reference. In the embodiment illustrated in FIG. 4, a plurality of rigid or semi-rigid interlocking pipe sections 50 make up each alternate intake pipe 14, and are sequentially threaded onto a crawler cable 52 at an access opening 54 to the main intake pipe 12. Centering guides (not shown) can be placed at either end of each pipe section 50 for this purpose. The opposite end of the crawler cable 52 is secured to an intake screen 55 disposed across an intake end 56 of the main intake pipe 12.

Each of the interlocking pipe sections 50 are pushed along the crawler cable 52 by means of an underwater robot 58, and are assembled in the main intake pipe 12 beginning at the intake end 56 thereof. One of more crawler cable guide rollers 60 can be disposed at the pipe corners as illustrated for easier installation of the pipe sections 50. The robot 58 is remotely controllable by means of a surface controller 62, and has a camera 64 mounted thereon for monitoring the pipe assembly process by means of a video monitor 66. An electrical cord or tether 67 electrically connects the robot 58 to the surface controller 62 and video monitor 66.

Figure 5:
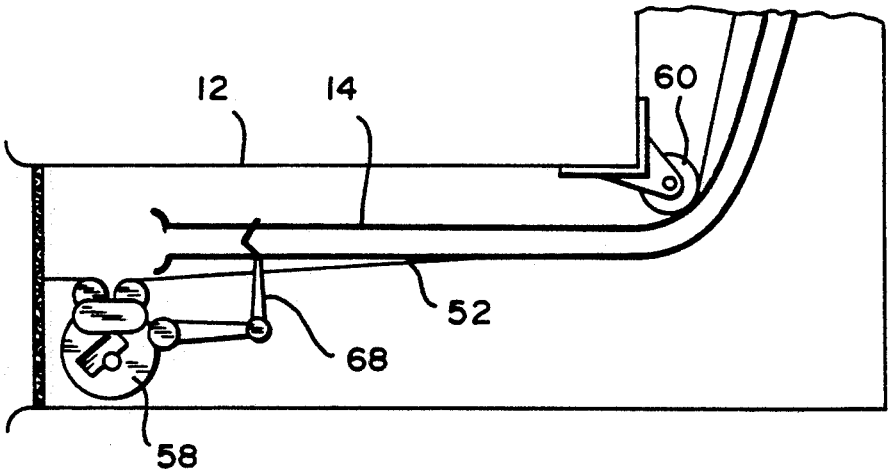

The length of each of the pipe sections 50 can be varied according to the geometry of the main intake pipe 12. In addition, if flexible joints of sufficient strength can be made between the adjacent pipe sections, or if the alternate intake pipe 14 is constructed of a flexible, ribbed hose-type pipe, the entire alternate pipe 14 can be inserted and positioned in the main intake pipe 12 in a single operation. This is accomplished either by using the cable crawler robot 58 as illustrated in FIG. 5 in which a controllable arm 68 on the robot 58 engages the alternate pipe 14, or by using a movable clothesline arrangement as illustrated in FIGS. 6 and 7.

Figure 6:
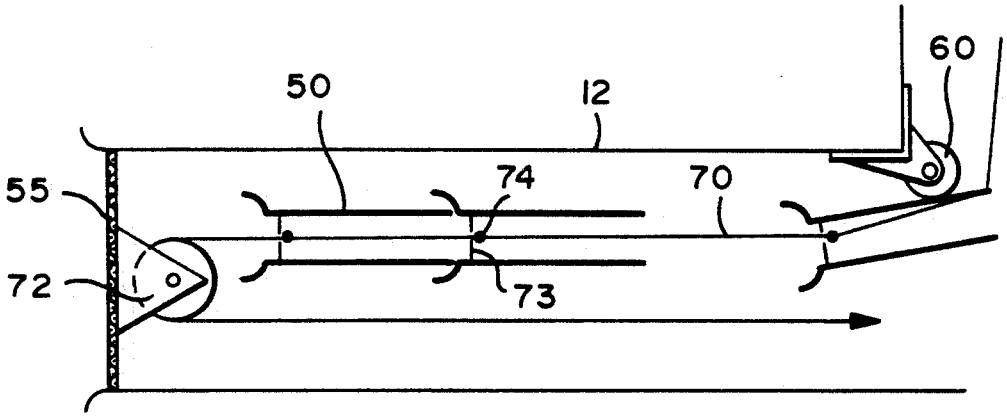
Figure 7:
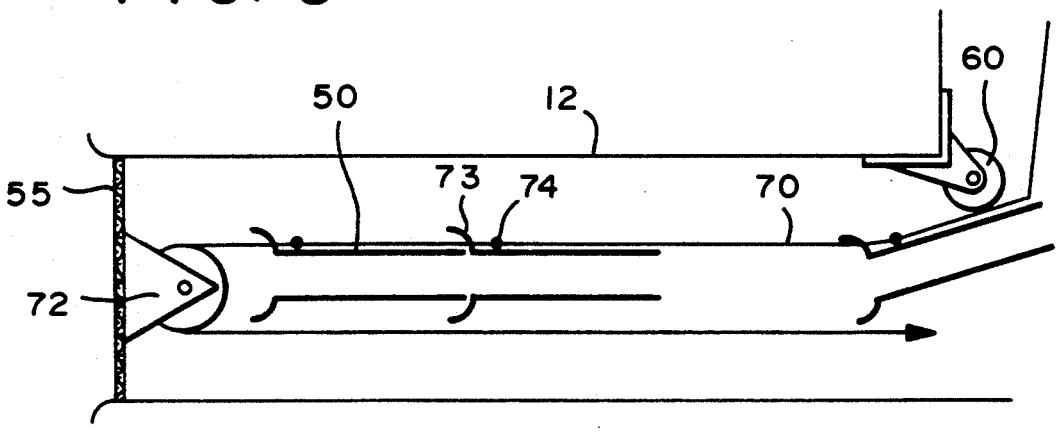

In the arrangements illustrated in FIGS. 6 and 7, a moveable cable 70 is threaded along the entire length of the main intake pipe 12 and around a cable pulley 72 mounted on the intake screen 55 at the intake end 56 thereof. The cable 70 is then threaded back toward the access opening 54. Each of the pipe sections 50 includes an apertured break away tab 73 through which the cable 70 is threaded. In the embodiment illustrated in FIG. 6, the apertured tab 73 is disposed within each of the pipe sections 50 so that the cable 70 is centrally disposed therein, while in the embodiment illustrated in FIG. 7, the apertured tab 73 is attached to the exterior of each of the pipe sections 50.

Figure 4:
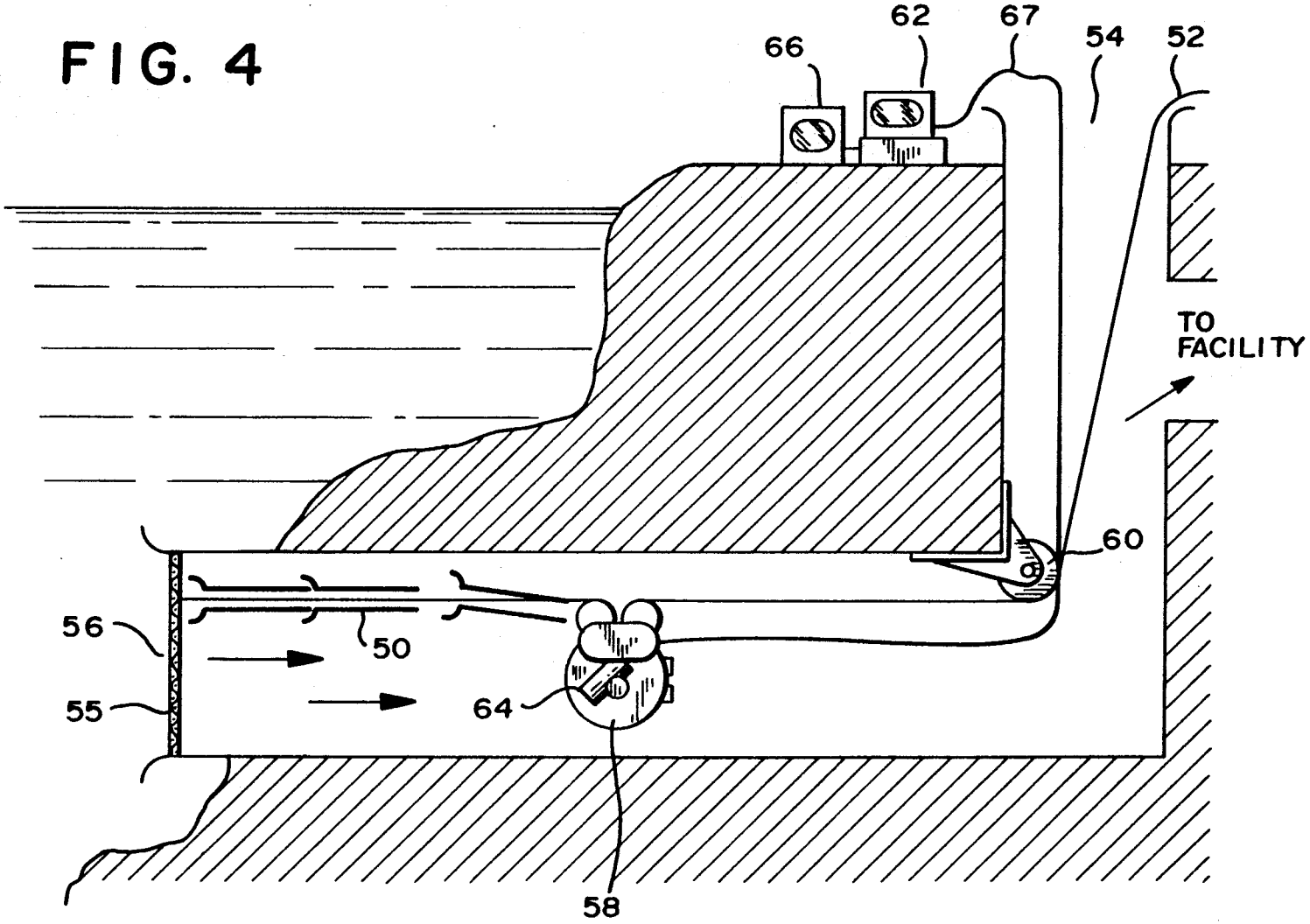

A plurality of pressure beads 74 are also threaded on the cable 70 between each of the pipe sections 50. These pressure beads 74 are designed to grip the cable 70 when less than a predetermined pressure is applied to them, but slip along the cable 70 when the applied pressure equals or exceeds the predetermined pressure. In this manner, the pressure beads 74 will grip the cable 70 with sufficient force so that when the beads 74 engage the apertured tab 73, movement of the cable 70 will cause each of the pipe sections 50 to be pulled into the intake pipe 12. However, once the first of the pipe sections engages the intake screen 55 and each of the other pipe sections 50 mates with adjacent pipe sections, the applied pressure to the pressure beads 74 greatly increases causing them to slip so that the cable 70 can continue to move unimpeded. This operation can be conducted from the surface adjacent the access opening 54 as illustrated in FIG. 4 by advancing the cable 70 through the main intake pipe 12 by any suitable means, such as by a winch mechanism, not shown. Once all of the pipe sections 50 are in place, a nonslipping bead can be attached to the cable 70 and advanced through the main intake pipe 12 so that each of the apertured tabs 73 can be broken off of their respective pipe sections and moved along with their associated pressure beads 74 out of the main intake pipe 12. This will eliminate any possible flow impediment presented by the apertured tabs 73.

In summary, the present invention provides a relatively simple, inexpensive means by which zebra mussel colonization can be eliminated from fresh water intake pipes without requiring physical removal of the mussels, facility shutdown or the use of a costly redundant intake pipe system.

Although the invention has been disclosed in terms of preferred embodiments, it will be understood that numerous modifications and variations could be made thereto without departing from the scope of the invention as defined in the following claims.

What is claimed is:

1. An intake water pipe system for preventing or eliminating zebra mussel colonization along the interior walls of one or more intake water pipes comprising:

a pump for supplying water to a facility;

a main intake pipe having an inlet end in communication with a water source and an outlet end in communication with said pump;

first and second generally parallel alternate intake pipes disposed within said main intake pipe, each having an inlet end in communication with said water source, an outlet end in communication with said pump, and a diameter smaller than that of said main intake pipe; and first controllable valve means disposed between said outlet end of said main intake pipe and said pump for selectively controlling the flow of water through said main intake pipe;

whereby, water flow through said main intake pipe can be selectively controlled to prevent or eliminate zebra mussel colonization in said main intake pipe.

2. The system of claim 1, further comprising:

a second controllable valve means disposed between said outlet end of said first alternate intake pipe and said pump for selectively controlling the flow of water through said first alternate intake pipe; and, a third controllable valve means disposed between said outlet end of said second alternate intake pipe and said pump for selectively controlling the flow of water through said second alternate pipe.

3. The system of claim 1 wherein said alternate intake pipe is constructed of flexible material.

4. The system of claim 1 wherein a non-stick coating is disposed on an interior wall of each said first and second alternate intake pipes.

5. A method for preventing or eliminating zebra mussel colonization in a water intake pipe comprising the steps of:

(a) placing at least a first alternate intake pipe within a main intake pipe, said alternate intake having a diameter smaller than that of said main intake pipe and said main intake pipe having an inlet end in communication with a water source and an outlet end in communication with a pump for supplying water to a facility, and wherein an inlet end of said alternate intake pipe is placed in communication with said water source and an outlet end of said alternate intake pipe is placed in communication with said pump;

(b) placing a first controllable valve means between said outlet end of said main intake pipe and said pump; and, (c) shutting off water flow in said main intake pipe with said first valve to eliminate zebra mussels therein.

6. The method of claim 5 wherein said first controllable valve means is periodically cycled closed for a time period sufficient to eliminate zebra mussels therein, and is then reopened to resume water flow therethrough.

7. The method of claim 5 further comprising the steps of:

(d) placing a second controllable valve means between said outlet end of said alternate intake pipe and said pump; and, (e) periodically cycling said second controllable valve means closed and then opened to periodically stop water flow through said alternate intake pipe and thereby eliminate zebra mussel build up therein.

8. The method of claim 5, further comprising the step of disposing a non-stick coating on an interior wall of said alternate intake pipe to prevent zebra mussel build up thereon.

9. The method of claim 5 wherein the step of placing at least a first alternate intake pipe within a main intake pipe further comprises:

(i) disposing a fixed cable within said main intake pipe; and, (ii) employing a cable crawling robot to move said alternate intake pipe within said main intake pipe by causing said robot to move along said fixed cable.

10. The method of claim 5 wherein the step of placing at least a first alternate intake pipe within a main intake pipe further comprises:

(i) disposing a moveable cable within said main intake pipe;

(ii) attaching an apertured tab to each of a plurality of interlocking pipe sections to be assembled into said alternate intake pipe;

(iii) threading said moveable cable through each of said apertured tabs;

(iv) attaching a plurality of pressure beads to said cable, one each between each pair of adjacent pipe sections to be assembled, each said pressure bead being selected to slip along said cable once a predetermined pressure is placed on said beads;

(v) advancing said moveable cable and thereby moving each said pressure bead into engagement with an associated one of said apertured tabs and thereby advancing each said pipe section into said main intake pipe until each of said sections is interlocked with adjacent sections.

11. The method of claim 10 further comprising the steps of:

(vi) securing a nonslipping bead to said cable; and, (vii) advancing said nonslipping pressure bead with said cable into consecutive engagement with each said slipping pressure bead to cause each said apertured tab to break away from each said pipe section.

12. A method for preventing or eliminating zebra mussel colonization in a water intake pipe comprising the steps of:

(a) selecting a plurality of alternate intake pipes, each said alternate intake pipe having an inlet and an outlet;

(b) placing said plurality of alternate intake pipes within a main intake pipe having an inlet end in communication with a water source and an outlet end in communication with a pump for supplying water to a facility, said plurality of alternate intake pipes being placed so that their inlet ends are in communication with said water source and said outlet ends are in communication with said pump;

(c) disposing a controllable valve means between said outlet end of said main intake pipe and said pump for selectively controlling water flow through said main intake pipe; and (d) closing said controllable valve means to stop water flow in said main intake pipe and thereby eliminate zebra mussels therein.

13. The method of claim 12 further comprising the step of disposing a non-stick coating on the interior wall of each said alternate intake pipe to prevent adherence of zebra mussels thereto.

14. The method of claim 12, further comprising the steps of:

(e) disposing a plurality of additional controllable valve means, one each, between each said alternate intake pipe and said pump, for selectively controlling water flow through each said alternate intake pipe; and (f) periodically cycling each said controllable valve means closed and then reopened to stop water flow in each said alternate intake pipe and said main intake pipe for a time period sufficient to eliminate zebra mussel build up therein.

15. An intake water pipe system for preventing or eliminating zebra mussel colonization along the interior walls of one or more intake water pipes comprising:

a pump for supplying water to a facility;

a main intake pipe having an inlet end in communication with a water source and an outlet end in communication with said pump;

at least a first alternate intake pipe disposed within said main intake pipe and having an inlet end in communication with said water source, an outlet end in communication with said pump, a diameter smaller than that of said main intake pipe, and a non-stick coating disposed on an interior wall thereof to prevent adherence of zebra mussels thereto; and first controllable valve means disposed between said outlet end of said main intake pipe and said pump for selectively controlling the flow of water through said main intake pipe;

whereby, water flow through said main intake pipe can be selectively controlled to prevent or eliminate zebra mussel colonization in said main intake pipe.

16. The system of claim 15, further comprising:

a second controllable valve means disposed between said outlet end of said alternate intake pipe and said pump for selectively controlling the flow of water through said alternate intake pipe.

17. The system of claim 15, further comprising:

at least a second alternate intake pipe disposed within said main intake pipe generally parallel to said first alternate intake pipe, said second alternate intake pipe also having an inlet end in communication with said water source and an outlet end in communication with said pump.

18. The system of claim 15, further comprising:

a second controllable valve means disposed between said outlet end of said first alternate intake pipe and said pump for selectively controlling the flow of water through said first alternate intake pipe; and, a third controllable valve means disposed between said outlet end of said second alternate intake pipe and said pump for selectively controlling the flow of water through said second alternate pipe.

19. The system of claim 15 wherein said alternate intake pipe is constructed of flexible material.

* * * * *